US005240259A

United States Patent [19]

O'Grady

[11] Patent Number: 5,240,259

[45] Date of Patent: Aug. 31, 1993

[54] COMBINED PAPER CLIP HOLDER AND MINIATURE BASKETBALL GOAL

[76] Inventor: Michael F. O'Grady, 190 Arroyo Ter. #308, Pasadena, Calif. 91103

[21] Appl. No.: 764,899

[22] Filed: Sep. 24, 1991

[51] Int. Cl.[5] ..... A63B 63/08; B43M 17/00

[52] U.S. Cl. ..... 273/402; 206/350; 206/818; 273/1.5 A

[58] Field of Search ..... 273/402, 398, 399, 400, 273/345, 1.5 R, 1.5 A; 206/350, 818

[56] References Cited

U.S. PATENT DOCUMENTS

| | | | |
|---|---|---|---|
| D. 235,897 | 7/1975 | Breneman et al. | 273/402 X |
| 1,508,147 | 9/1924 | Vinal | 273/1.5 R X |
| 2,217,514 | 10/1940 | Henry | 206/818 X |
| 2,457,421 | 12/1948 | Warren | 206/818 X |
| 3,244,420 | 4/1966 | Poynter | 273/402 |
| 3,587,835 | 6/1971 | Shore | 206/350 |
| 3,592,470 | 7/1971 | Breslow | 273/399 X |
| 3,692,072 | 9/1972 | Kohls | 273/400 X |
| 3,724,855 | 4/1973 | Chu | 273/399 |
| 3,750,868 | 8/1973 | Cooper | 206/818 X |
| 3,906,658 | 9/1975 | Gross | 206/818 X |
| 4,052,064 | 10/1977 | Kennoy | 273/402 X |
| 5,064,195 | 11/1991 | McMahon et al. | 273/1.5 X |

*Primary Examiner*—William H. Grieb
*Attorney, Agent, or Firm*—Sheldon & Mak

[57] ABSTRACT

A scaled-down basketball goal, backboard, and basketball standard attached to a base in the shape of a scaled-down basketball key. Said base has at its front end a highly magnetized concaved portion which can attract and hold numerous paper clips. The miniaturized basketball hoop has a funnel attached to it. This funnel has a basketball net painted or imprinted on it. The hoop and funnel are located directly over said concaved portion of the base portion so that when paper clips are tossed through said hoop, they will fall directly into the highly magnetized concave portion of this invention.

1 Claim, 5 Drawing Sheets

COMBINED PAPER CLIP HOLDER AND MINIATURE BASKETBALL GOAL

BACKGROUND OF THE INVENTION

1. Field of the Invention

This invention relates to the area of office supplies. Specifically, this invention relates to an office supply item which incorporates a miniature basketball goal together with a version of a paper clip holder. This combination of items heretofore not combined, provides an office desk item which has both utilitarian and amusement value.

The term "standard paper clip" is here used to designate the common type of paper clip having elongated parallel sides and rounded ends. The invention is useful with various ferromagnetic articles, however, the description of the novel receptacle of the present invention will be mainly concerned with standard paper clips.

On top of most office desks can be found some version of a paper clip holder. These receptacles are used by executives and office workers to hold numerous paper clips in one convenient location. Inventors have created several types of paper clip holders. These are either a separate unit or a part of a multi-functional desk top organizer. None of these, however, no matter what the embodiment, offer an amusement feature in combination with the paper clip holder feature. My invention does provide these features in combination and additionally, because of its basketball motif, makes a statement that its owner is a sports fan. Also, my invention makes collecting paper clips fun and thus livens up an otherwise dull area, the office desk.

2. Description of the Related Art

The paper clip holders, and/or ferrous object retaining devices which have been invented, hold bunches of paper clips and/or ferrous objects satisfactorily in various ways. U.S. Pat. No. 3,587,835 to Shore (1971) describes a box shaped holder with a round magnetized opening at its top end for use in holding paper clips. U.S. Pat. No. 2,457,421 to Warren (1948) discloses a box shaped magnetic retaining device with a beveled top used for retaining paper clips or similar ferrous objects. U.S. Pat. No. 3,906,658 to Gross (1975) discloses a spherically shaped magnetic device used for arranging small magnetizable items into aesthetically pleasing designs.

In regards to the area of small games apparatus, there have been various scaled-down versions of the well-known game of basketball developed. None of these, however, incorporate both an office desk apparatus and a basketball goal into their basic design. U.S. Pat. No. 3,244,420 to Poynter (1966) discloses a scaled-down basketball backboard, hoop, and net with means of securing the invention, temporarily, to the upper peripheral rim of a receptacle, especially a common waste basket. U.S. Pat. No. 3,724,855 to Chu (1973) discloses a simulated and scaled-down basketball game with catapult used for shooting a ball. U.S. Pat. No. 4,052,064 to Kennoy (1977) discloses a simulated basketball game played on a game board with a miniaturized basketball court representation of the game board. The latter invention employs disc shaped playing pieces used to project other disc pieces towards a miniature basketball goal.

SUMMARY

The combined paper clip holder and miniature basketball goal is a paper clip receptacle with a scaled-down basketball goal attached. It is used on top of an office desk to hold paper clips and/or other small magnetic articles. The advantage of this paper clip holder is that it not only offers a form of amusement, but it also allows the user a more convenient way to store paper clips by tossing them in the holder as opposed to reaching to put them in the holder.

There are at least two ways of using the combined paper clip holder and miniature basketball goal. First, after removing a paper clip from a group of papers, one can shoot the clip through the miniature basketball hoop, whereupon it will funnel directly into a concaved magnetized portion of a base section. Or, the second mode of operation would be to simply place the paper clip into said concaved magnetized portion of said base. One shoots or tosses a paper clip in a manner similar to shooting an actual basketball, only the object being shot, a paper clip, is of course much smaller. There is also the option, when shooting the paper clip, of either banking it off the miniature backboard into said funnel or by shooting it straight through the hoop portion and funnel.

Besides its utilitarian and amusement values, it also has an appealing appearance, especially to the sports fan and, consequently, it can also serve as a conversation piece. This appearance would be more enhanced provided requisite permissions are obtained to decorate it with certain professional and/or collegiate team logos. The cost to produce this invention would be relatively low since in the most likely scenario it would be made out of plastic using commonly known means of manufacturing. The strong magnetic field used in the base of this invention would attract and hold very many paper clips. Also, the relative heaviness of the base counteracts any top heaviness and also enables the invention to be used as a paper weight.

The following description should not be construed as limiting the scope of the invention but as providing illustrations of the presently preferred embodiment of this invention. For example, the size and/or shape of the miniature hoop, the funnel, the miniature backboard, the miniature standard, and the base could be altered in order to accommodate numerous possible design alternations. And different materials, besides or in addition to plastic, could possibly be used.

Thus, the scope of the invention should be determined by the appended claims and their legal equivalent, rather than by the examples given.

Accordingly, several objects and advantages of my invention are:

(a) to provide a version of a paper clip holder which has a miniature basketball goal attached to it;

(b) to provide a design for such a combined paper clip holder and miniature basketball goal which incorporates one or more of the following: a miniature basketball goal, a miniature basketball backboard, a miniature basketball standard or support, and/or a miniature basketball key;

(c) to provide a design for said combined item which locates said goal directly over said paper clip holder;

(d) to provide a magnet and permanently encase it within said paper clip holder portion so that paper clips falling through said miniature goal will be retained;

(e) to provide a manufacturing scheme for said combined item which would have a production cost comparable with other paper clip holders currently manufactured;

(f) to provide a manufacturing scheme for said combined item which would utilized recyclable materials to the extent feasible;

(g) to provide a design for said combined item which would allow sufficient surface area for decoration by name and trademark logos, and certain team and/or organization logos;

(h) to provide a design for said combined item which would allow amusement by its use; and (i) to provide such a combined item which would allow the option of tossing paper clips into said holder without the necessity of physically moving and/or reaching to place a paper clip in a holder, thus my invention makes the collection of paper clips convenient.

Still further objects and advantages of my invention will become apparent from a consideration of the following description and claims, considered together with the accompanying drawings.

BRIEF DESCRIPTION OF THE DRAWINGS

In the drawings, closely related figures have the same numeral indexes. Dimensions are approximations and are only delineated in order to give perspective.

Figure 1:
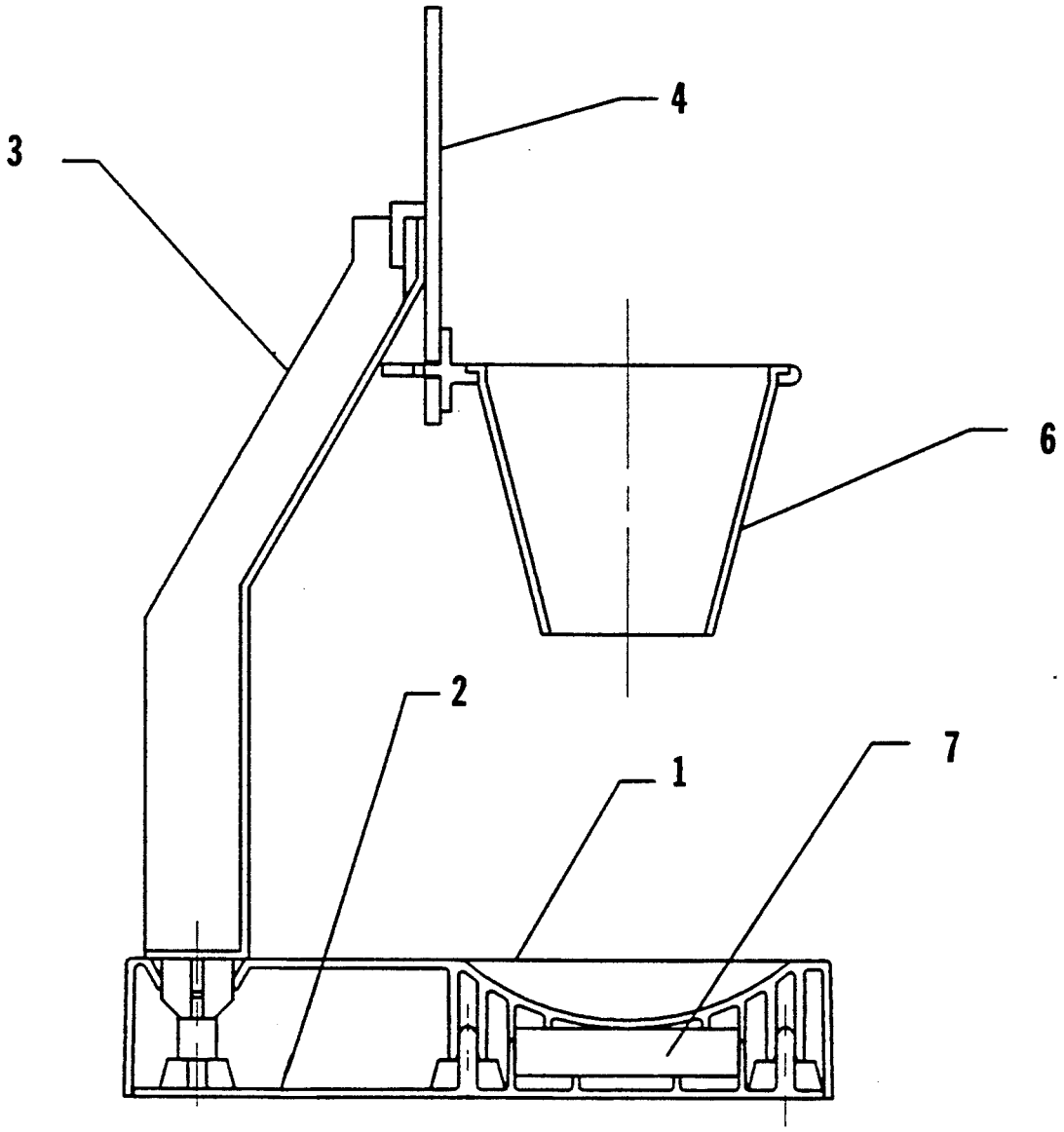
FIG. 1 is a sectional side view of my invention showing the formation of the base housing and the disposition of a permanent magnet therein.

Part nomenclature is as follows:

(1) base, upper or top surface area
(2) base, lower or underneath surface area
(3) miniature backboard support or miniature basketball standard
(4) miniature basketball backboard
(5) miniature basketball hoop
(6) funnel
(7) magnet

DESCRIPTION OF THE PREFERRED EMBODIMENT

Figure 2:
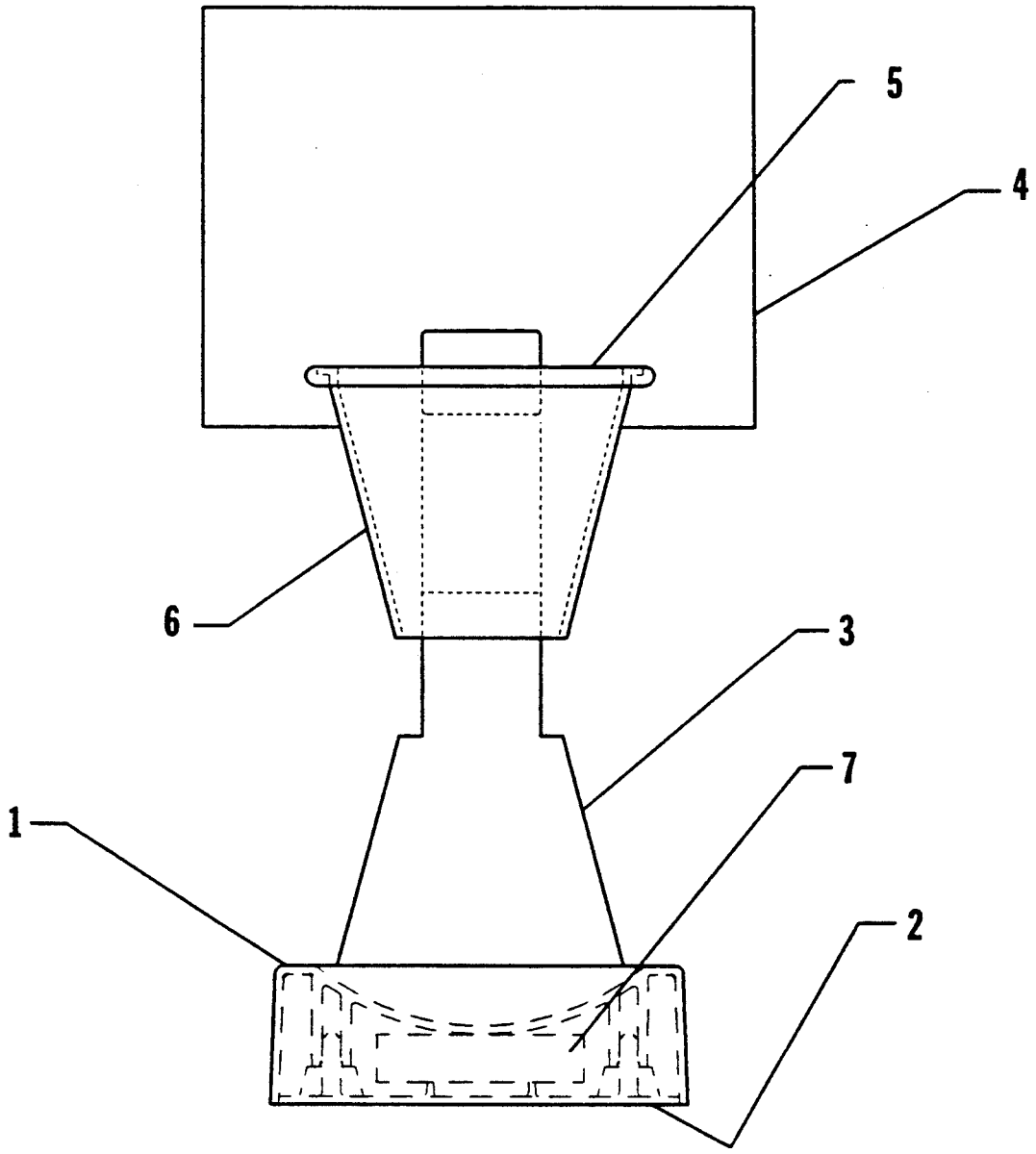
FIG. 2 is a front view of my invention showing the formation of the base housing and the disposition of the permanent magnet therein.
Figure 3:
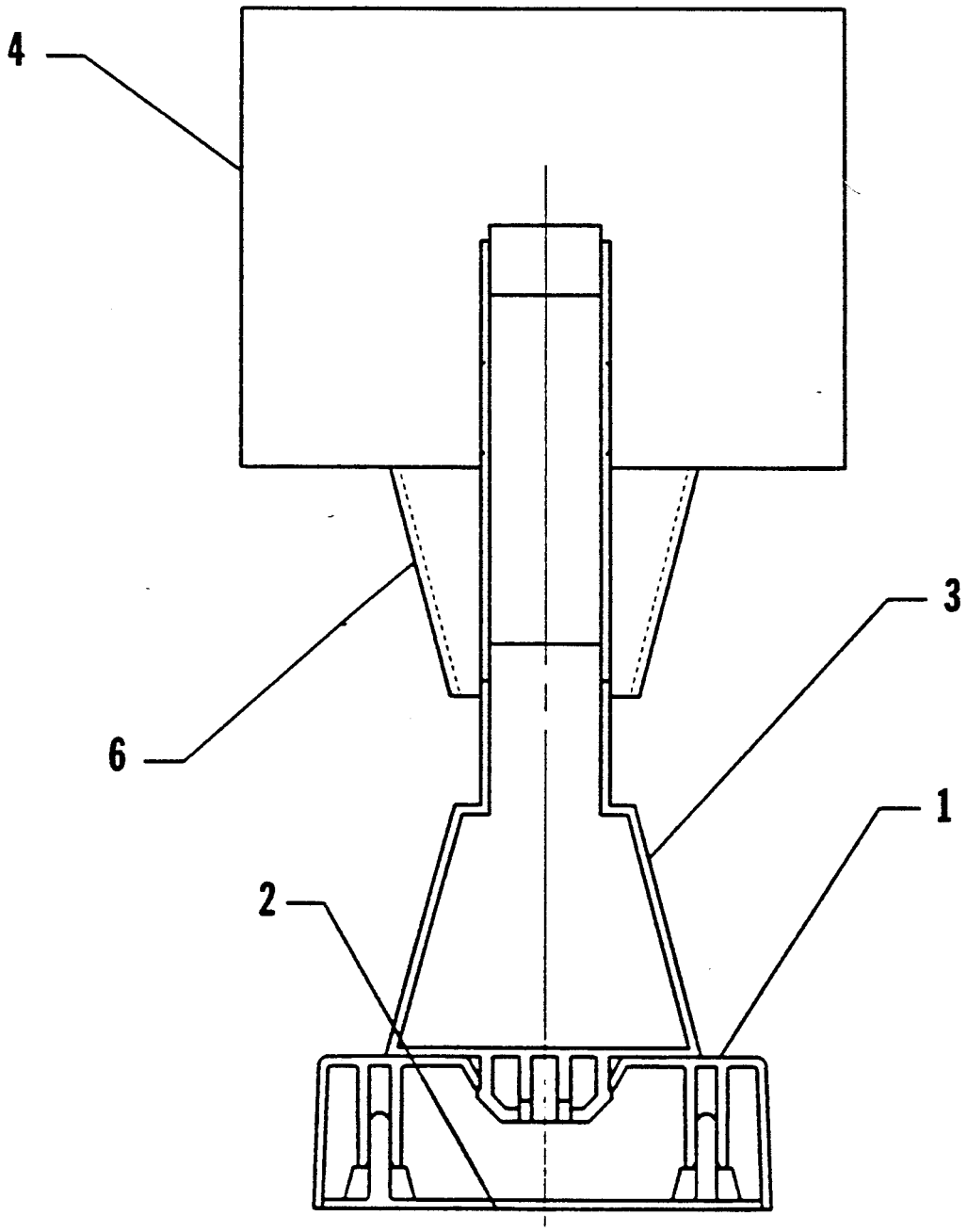
FIG. 3 is a sectional rear view of my invention showing the formation of the base housing from a rear angle.

A typical embodiment of my invention is illustrated in FIG. 2. In this preferred embodiment, all the parts, except the permanent magnet, would be made of strong, durable plastic. It is preferable to mold all the plastic pieces in Acrylonitrile Butadiene Styrene, more commonly referred to as ABS. ABS material offers good moldability, superior strength, good wear resistance, and can be decorated. A less rugged, but viable alternative plastic material would be high impact styrene. The magnet, of source, is of a permanent ferromagnetic material.

All of the plastic pieces would be injection molded and require the normal processes associated with this procedure. The basic manufacturing equipment for this embodiment would be injection molding machines having the minimum pressure and size requirements to mold each part, and small arbor presses and/or sonic welding equipment for the housing and hoop assemblies. The magnet would be a purchased, stock item.

Four of the six plastic pieces lend themselves to a decoration operation, in addition to their molded color. The upper base piece would receive a scheme similar to the floor markings on a basketball court. The base, the backboard and support would receive markings which further enhance a basketball scenario. Lastly, the clear funnel will be painted to suggest the strings of an actual basketball net. Ink printing or the use of decal(s) would be an alternative to paint operations on some or all of the pieces.

Two subassemblies would be required at the factory. These, together with the remaining product components, would be packaged, then permanently assembled by the consumer. The base unit subassembly would permanently trap the magnet between the upper and lower halves. The upper and lower pieces would be solvent bonded together by means of a wet pin and sleeve system. An alterative method for combining these parts would be the use of screws. The funnel and hoop subassembly would be made by bonding the funnel into the hoop. A plastic solvent or glue would be utilized or, alternatively, these two pieces would be sonic welded together. To complete the assembly, the consumer would snap the backboard support into the base unit, snap the net and hoop subassembly into the backboard, then slide the backboard assembly into the backboard support.

The foregoing description of possible materials to be used, manufacturing process and subassembly process is not to be construed as a limitation of my invention, but is furnished only for those desiring a detailed embodiment. Numerous other materials would lend themselves to use in the production of my invention in one or more various combinations. For example, wood, glass, other type(s) of plastic, metal, stone or graphite could be used, just to mention a few.

The base part is square shaped at its rear end and semi-circular shaped at its front end. The top surface of said base is flat at its rear end and has a circular concaved depression at its front end. This concaved portion is the magnetized portion which attracts and holds paper clips. Because of the thickness of said base, and the magnet contained therein, said base is heavy enough to support the top weight of the subject invention.

Figure 4:
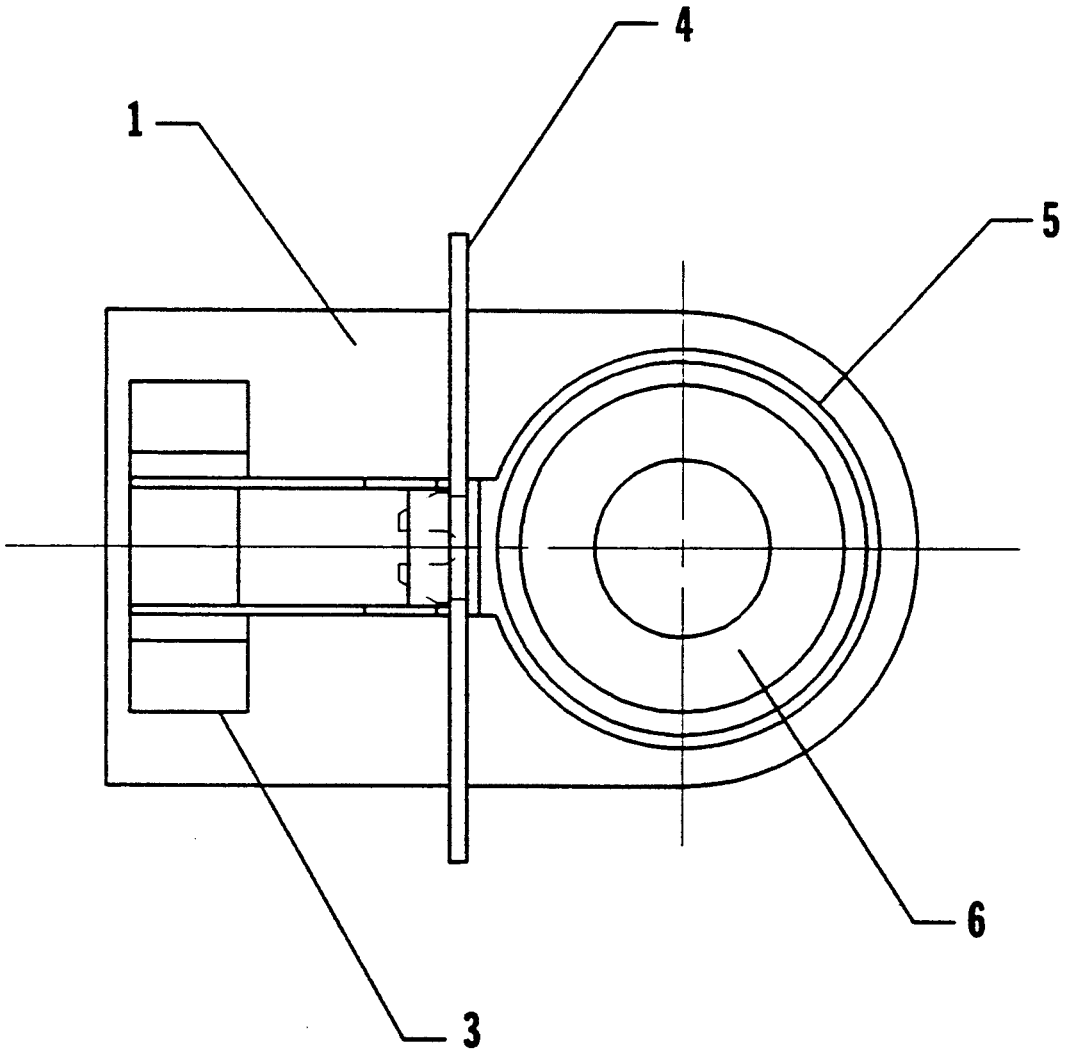
FIG. 4 is an overhead view of my invention indicating the center or target area of the paper clip holder portion of the base portion via vertical and horizontal lines.
Figure 5:
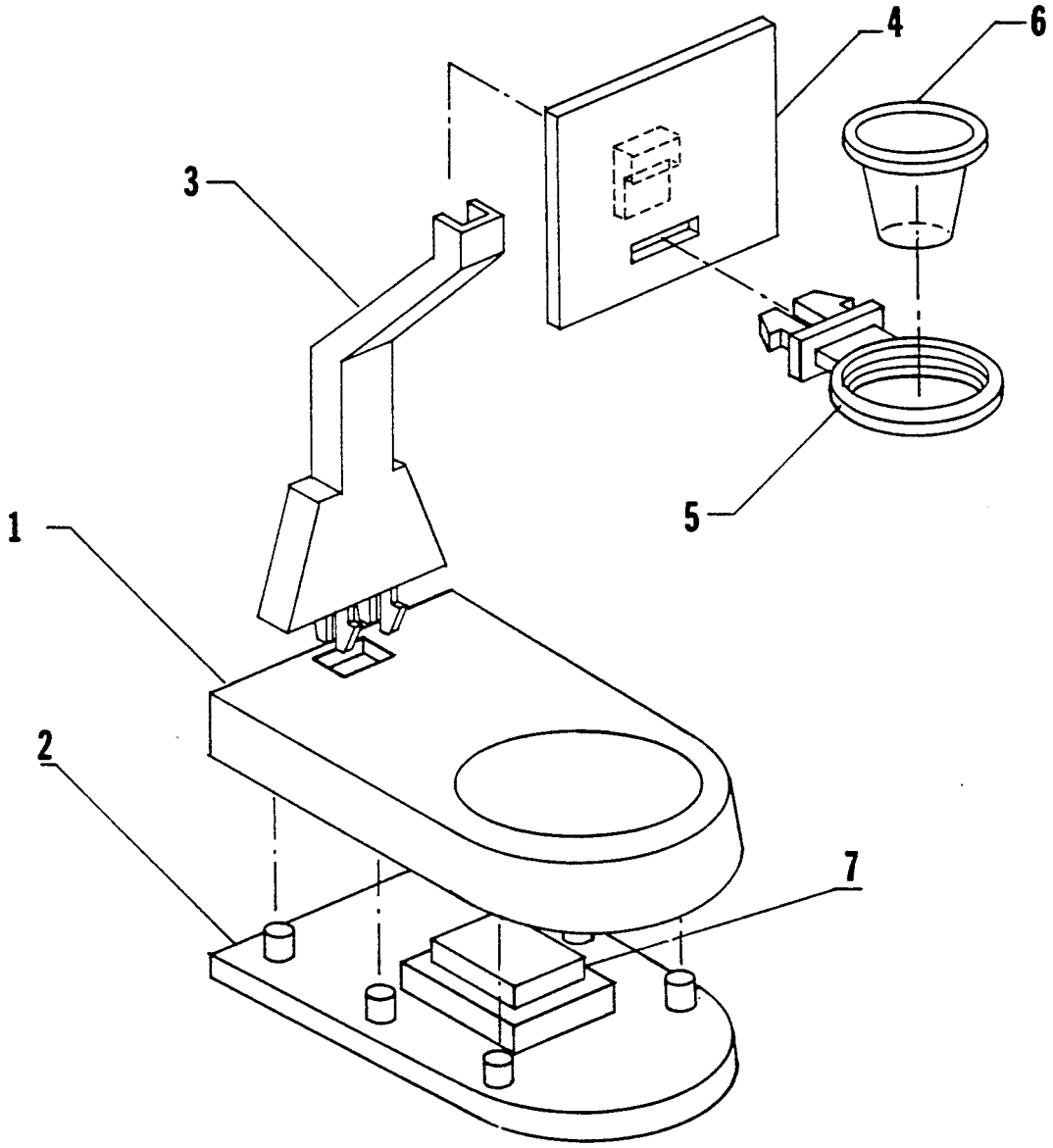
FIG. 5 is an exploded view illustrating the various sectional parts of my invention.

The miniature basketball standard extends upwards from the rear end of said base. The lower portion of said standard extends vertically and the upper portion extends angularly from the lower portion towards the front end of said base. Connected to the uppermost point of said standard on its back side is the miniature basketball backboard. Attached to the front end of said backboard is the miniature basketball hoop and funnel. Both ends of the funnel are open. The hoop can be made of varying sizes in order to accommodate varying degrees of paper clip shooting skills. From the top view (FIG. 4) it can be clearly seen that the hoop and funnel are positioned directly over the center of said concaved portion of said base and that said hoop is circular shaped and that said funnel has a tapered circular shape.

From the description above, a number of advantages of the combined paper clip holder and miniature basketball goal become evident:

(a) the cost to produce my invention would be comparable with the cost to produce other paper clip holders currently available;

(b) the amusement features and appearance qualities of my invention make it very appealing to executives and other desk workers who are also sports fans;

(c) my invention is a novel idea and thus a higher mark-up than usual could be commanded;

(d) my invention could possibly incorporate recyclable materials in some portion of its manufacture;

(e) the possibility of securing the right to collegiate and professional logos, if obtained, would significantly enhance the appeal of my invention;

(f) my invention can also be used as a paper weight;

(g) my invention can be used as a container for any small ferromagnetic articles.

I claim:

1. A holder for paper clips which has attached as an integral part of it a miniature basketball goal, with the said holder comprising:

(a) a piece of rigid material of sufficient size having a portion large enough to accommodate a supply of paper clips, (b) a magnet affixed underneath said rigid material for use in attracting and holding paper clips in said portion, (c) a miniature basketball backboard attached to said rigid material by means of a miniature basketball backboard standard, (d) a miniature basketball goal attached to said miniature basketball backboard, and (e) whereby, said holder will offer amusement as part of, and within, a practical item of apparatus, as well as lending itself as a conversation piece and status item.

* * * * *